US010737453B2

(12) United States Patent
Zeilstra et al.

(10) Patent No.: US 10,737,453 B2
(45) Date of Patent: Aug. 11, 2020

(54) APPARATUS AND METHOD FOR CREATING CORRUGATED CARDBOARD ON-SITE OF SYSTEMS FOR AUTOMATICALLY FORMING PACKAGING BOXES

(71) Applicant: Neopost Technologies, Bagneux (FR)

(72) Inventors: Joost Zeilstra, Drachten (NL); Fokke De Boer, Drachten (NL); Muhamber Eglence, Drachten (NL); Olaf De Jong, Drachten (NL)

(73) Assignee: QUADIENT TECHNOLOGIES FRANCE, Bagneux (FR)

( * ) Notice: Subject to any disclaimer, the term of this patent is extended or adjusted under 35 U.S.C. 154(b) by 276 days.

(21) Appl. No.: 15/785,814

(22) Filed: Oct. 17, 2017

(65) Prior Publication Data

US 2018/0117870 A1 May 3, 2018

(30) Foreign Application Priority Data

Oct. 28, 2016 (EP) ..... 16 196 482

(51) Int. Cl.
*B31B 50/00* (2017.01)
*B31F 1/28* (2006.01)
(Continued)

(52) U.S. Cl.
CPC ..... *B31B 50/006* (2017.08); *B31B 50/005* (2017.08); *B31B 50/62* (2017.08);
(Continued)

(58) Field of Classification Search
None
See application file for complete search history.

(56) References Cited

U.S. PATENT DOCUMENTS 8,460,496 B2 * 6/2013 Casey ..... B31F 1/2881 156/207
2008/0020916 A1 1/2008 Magnell
(Continued)

FOREIGN PATENT DOCUMENTS

EP 1 284 320 A2 2/2003
EP 1 403 034 A2 3/2004
(Continued)

OTHER PUBLICATIONS

Extended European Search Report, dated May 10, 2017, for European Application No. 16196482.0-1708, 7 pages.

*Primary Examiner* — Barbara J Musser
(74) *Attorney, Agent, or Firm* — Cozen O'Connor

(57) ABSTRACT

An apparatus to create corrugated cardboard on the site of a system for automatically forming packaging boxes for packaging an arrangement of one or more item(s) to be shipped, said corrugated cardboard having at least one corrugated layer between two flat layers, comprising at least two supply stations for supplying two different single-faced corrugated cardboards, each single-faced corrugated cardboard comprising a corrugated layer (having a closed side with an attached flat layer and an open side opposite to said closed side, a supply station for supplying a closing layer, a microprocessor communicatively coupled to obtain information on the arrangement to be shipped, the information relating to at least one of overall dimensions, weight, shape, shipping conditions, fragility, sensitivity to moisture, value, shipping destination, and the obtained information allowing selection, based on the obtained information, of at least one of said at least two different single-faced corrugated cardboards, and an attaching station that attaches the closing layer to the selected first single-faced cardboard to sandwich
(Continued)

the corrugated layer between the flat layer and the closing layer.

15 Claims, 3 Drawing Sheets

(51) Int. Cl.

| | |
|---|---|
| ***B31B 50/62*** | (2017.01) |
| ***B31B 50/81*** | (2017.01) |
| ***B31B 50/88*** | (2017.01) |
| ***B31F 1/20*** | (2006.01) |

(52) U.S. Cl.
CPC ..... *B31B 50/814* (2017.08); *B31B 50/88* (2017.08); *B31F 1/20* (2013.01); *B31F 1/2822* (2013.01); *B65B 2210/04* (2013.01)

(56) References Cited

U.S. PATENT DOCUMENTS

| | | | | |
|---|---|---|---|---|
| 2013/0210597 | A1 | 8/2013 | Pettersson | |
| 2015/0019387 | A1* | 1/2015 | Pettersson ..... | G06Q 30/0635<br>705/26.81 |
| 2016/0221291 | A1* | 8/2016 | Huizinga ..... | B31D 3/005 |

FOREIGN PATENT DOCUMENTS

| | | | |
|---|---|---|---|
| EP | 3 050 809 | A1 | 8/2016 |
| WO | 2014/117817 | A1 | 8/2014 |
| WO | 2014/119439 | A1 | 8/2014 |
| WO | 2014/188010 | A2 | 11/2014 |

* cited by examiner

APPARATUS AND METHOD FOR CREATING CORRUGATED CARDBOARD ON-SITE OF SYSTEMS FOR AUTOMATICALLY FORMING PACKAGING BOXES

TECHNICAL FIELD OF THE INVENTION

The application relates to an apparatus and a method for creating corrugated cardboard on-site of systems for automatically forming packaging boxes for packaging an arrangement of one or more item(s) to be shipped, said corrugated cardboard having at least one corrugated layer between two flat layers. The application also relates to a system and a method for automatically forming packaging boxes using said apparatus respectively said method.

BACKGROUND OF THE INVENTION

In recent years, mail ordering has become increasingly common. In order to cope with the increased need for packaging mail ordered items, different systems and methods for automatically forming packaging boxes have been proposed.

US 2008 0020916 A1 discloses a box-making machine, which executes creasing and cutting steps to obtain a cardboard blank, which is then folded to obtain a packaging box from the blank. The embodiments described herein may be advantageously used in this type and similar types of machines.

For making cardboard blanks to be used in box-making machines, usually a long web of cardboard is fed to such machine either from a roll of corrugated cardboard or from a stack, in which the web is zigzag folded into panels. Corrugated cardboard from a roll is flexible in one direction, as it comprises only one flat layer to which a corrugated layer is attached. Such type of corrugated cardboard is called hereinafter "single-faced corrugated cardboard" and, while it has a certain thickness and is hence a three-dimensional body, only the two main surfaces are addressed as "sides", namely the so called "closed side", to which the flat layer is attached, and the open side, which shows the corrugated structure.

Without special measures or treatment, single-faced corrugated cardboard is not well suited for making packaging boxes. Hence, so called "standard" corrugated cardboard, which is rather stiff as it comprises a corrugated layer sandwiched between two flat layers, is preferred for making packaging boxes. However, such cardboard cannot be stored on a roll and hence is usually provided in form of a stack of zigzag folded panels. US 2013 0210 597 A1 discloses a machine for creating blanks from zigzag folded panels provided from different stacks.

Zigzag folded cardboard has the disadvantage that there are transversal folds in the source material at the positions where the panels are connected. These folds are usually not at positions where folds are needed in a blank that is to be cut from the source material. This is especially the case, when the sizes of the blanks to be cut vary while the panels in a stack of cardboard have a fixed size.

Avoiding the situation where a fold in the source material will appear in the blank limits the maximum blank size (namely, limited to the distance between two folds), and causes an undesired amount of waste material. When such folds are present in a blank that is used to fold a piece of packaging such as a box, there is a risk that the blank will not be folded at the intended crease lines, but at the folds that are already present in the source material. This may cause undesired effects during or after the fold process and may cause crashes and/or damage to the packaging and/or item(s) being packed or result in an undesired appearance of the packaging and/or insufficient protection of the item(s) inside the packaging.

WO 2014 188010 A1 proposes an apparatus and a method that allow rigidifying cardboard having at least one fold and obtaining packaging material with increased stiffness from a cardboard stack that is formed by zigzag folding a cardboard web into panels connected via transverse folds, by applying creasing means to form in particular line-shaped indentations on at least one side of said cardboard, wherein at least some of said indentations intersect said at least one fold. This apparatus and method purportedly advantageously improve the production of cardboard boxes using cardboard from a stack of a zigzag folded cardboard web with transverse folds in respect of preciseness and/or stability of the cardboard boxes.

However, while the apparatus and method disclosed in WO 2014 188010 A1 work perfectly well in many cases, just forming indentions that intersect the unwanted folds may not in all cases lead to sufficient stiffness, in particular when rather thin material is used and/or the formed boxes are rather big and/or items to be packaged in said boxes are rather heavy.

WO 2014 119 439 A1 discloses different methods for creating standard corrugated cardboard having at least one corrugated layer sandwiched between two flat layers on or at the site of a system for automatically forming packaging boxes. According to one of the methods, single-faced corrugated cardboard from a roll is provided and a second flat layer is glued to it. Another method comprises forming a corrugated layer on-site and gluing two flat layers onto opposite sides of the thus created corrugated layer. However, it has turned out in practice that the gluing unit needed for applying glue to the respective layers on-site is rather complex, costly and requires a lot of maintenance.

WO 2014 119439 A1 also discloses a method of forming so-called "double corrugated" cardboard, in which the corrugated sides of two single-faced corrugated cardboards are brought into engagement with each other with little or no glue. However, it has turned out that without glue the cohesion between the two single-faced cardboards is not sufficient. Moreover, double-corrugated cardboard with two corrugated layers means using a lot of material, which not only increases costs and weight of the packaging boxes formed therefrom, but also increases waste.

In order to improve creating corrugated cardboard on the site, where the cardboard is needed, in particular on or at the site of a system for automatically forming packaging boxes, EP 3 050 809 A1 discloses a method and an apparatus, in which the open side of a single-faced corrugated cardboard, i.e. cardboard comprising a corrugated layer and a first flat layer, is "closed" by attaching on-site a so called "closing layer", i.e. a second flat layer to it and hence sandwiching the corrugated layer between the first flat layer and the second flat layer. According to EP 3 050 809 A1, at least one of the corrugated layer or the second flat layer has adhesive properties that can be activated on-site, e.g., by removing a protective cover, by contacting it with the other layer, or by subjecting the respective layer to pressure, heat etc.

Cardboard created on-site and hence having no unwanted folds can advantageously be used, e.g., in a machine such as the one disclosed in WO 2014 117 817 A1, which allows creating a fully custom sized box, i.e., a box, of which width, length and height are adapted to the respective content of the box.

However, the hitherto known methods and apparatus for creating cardboard on-site always employ only one type of single-faced corrugated cardboard to which a closing layer, i.e., a second flat layer, is attached. While such closing layer may add a quality like water repellency, the strength and stiffness of a box to be folded from the cardboard created on-site is mainly determined by the type of single-faced corrugated cardboard used for creating the double-faced cardboard. Thus, while the cardboard created with the known methods and apparatus might be too weak for folding stable boxes for certain arrangements of one or more item(s) to be shipped, it might be stronger (and hence generally heavier, more material consuming and more expensive, both, in production and in postage) than necessary for other arrangements.

SUMMARY

It is an object of the invention to disclose an improved apparatus and a method that allow creating of cardboard on the site of a system for automatically forming packaging boxes for arrangements of one or more item(s) to be shipped, wherein the number and size of the items in each arrangement will typically vary in each arrangement.

The object is achieved by method according to claim 1 respectively by an apparatus according to claim 9. Advantageous embodiments and implementations are subject to the respective dependent claims.

Independent claim 14 relates to a system for automatically forming packaging boxes from cardboard comprising an apparatus according to claim 9. Such system will typically comprise numerous stations like a station for cutting out blanks, which may be customized individually, a station for providing a blank with crease lines and a station for folding a box from said blank.

Independent claim 15 is directed to a method for automatically forming packaging boxes from cardboard comprising the steps of a method for creating cardboard according to claim 1.

It has turned out that by allowing selecting amongst at least two different types of single-faced corrugated material for creating stiff cardboard having a corrugated layer sandwiched between two flat layers, the properties of the boxes formed from the cardboard created on-site can be easily adjusted to the needs of the specific arrangement of one or more items to shipped, while advantageously the number of different packaging materials to be kept in stock respectively to be provided for creating the cardboard is kept to a minimum.

Further objects, features and advantages of the invention will become apparent from the following non-limiting description of preferred embodiments in conjunction with the accompanying drawings.

DETAILED DESCRIPTION OF PREFERRED EMBODIMENTS

Figure 1:
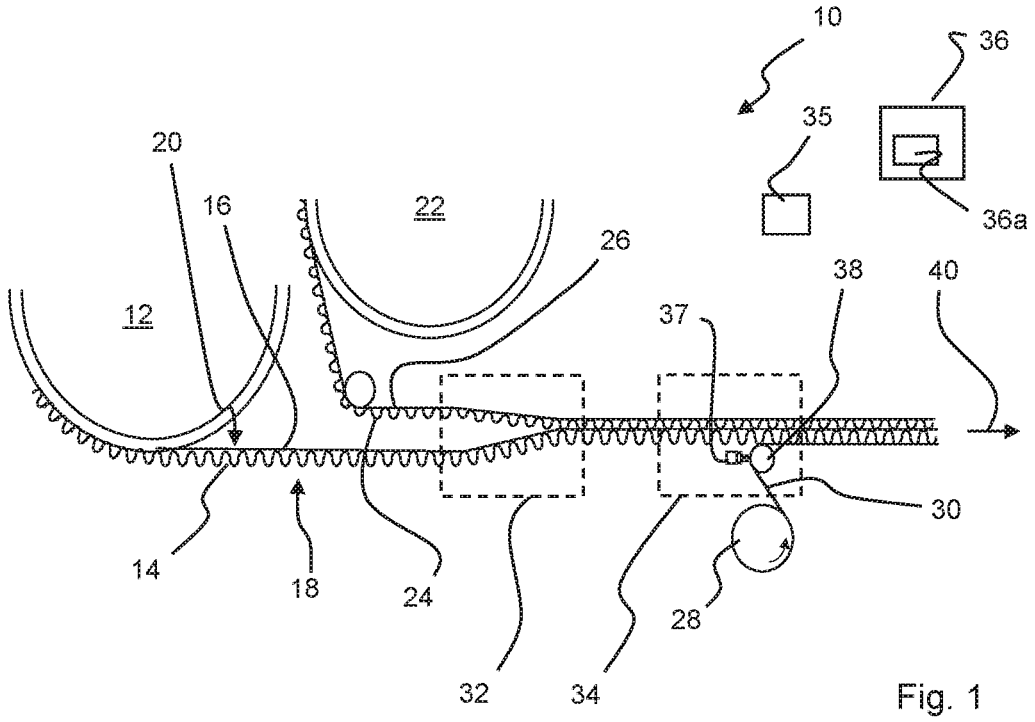
FIG. 1 is a schematic diagram of an apparatus according to a first embodiment of the invention.

FIG. 1 shows at least some parts of an apparatus 10 according to a first embodiment of the invention, which comprises a first supply station 12 that supplies a first single-faced corrugated cardboard having a corrugated layer 14 and a flat layer 16 attached to one side of the cardboard, so that the cardboard forms a so-called "open side" 18, which open side shows or makes visible the corrugated structure, and a so-called "closed side" 20 from which the corrugated structure is not shown or visible.

Apparatus 10 further comprises a second supply station 22 that supplies a second single-faced corrugated cardboard having a corrugated layer 24 and a flat layer 26 attached to one side of the cardboard. The second single-faced corrugated cardboard differs from the first single-faced corrugated cardboard in at least one or more of the following in physical characteristics: tear strength, stiffness, thickness, grammage and water repellency.

A third supply station 28 is provided that supplies a closing layer 30, which in this embodiment is a substantially flat layer like the layers 16 and 26. Like the supply stations 12 and 22, supply station 28 is in this schematic view is depicted as a drum comprising the respective material, while, as is apparent from the teachings herein, the stations also comprise transport or conveyance structures, for example driven rollers and guiding rollers to transport the respective material to an attaching station, where the materials selected for creating a specific cardboard are attached to each other, as will be described below.

In this embodiment, apparatus 10 further comprises two separate attaching stations 32 and 34 indicated by the dashed lines, in which—if selected—the first and the second single-faced cardboards are attached to one another and the closing layer 30 is, in the shown situation, attached to the open side 18 of the first single-faced cardboard.

Figure 2A:
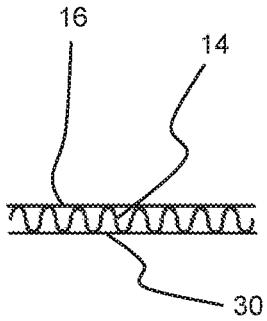
FIGS. 2A, 2B and 2C are side elevational views of three respective cardboard variations that can be created with the apparatus shown in FIG. 1.
Figure 2B:
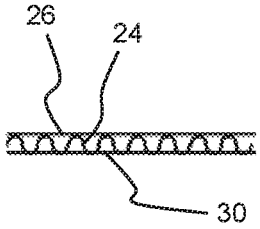
Figure 2C:
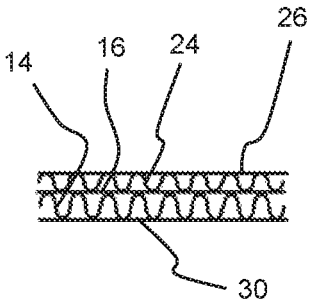

As depicted in FIGS. 2A, 2B and 2C, the apparatus shown in FIG. 1 allows creating three different types of cardboard, each having different physical properties, e.g., stiffness, tear strength, etc., and hence each fulfilling user defined criteria for a certain box to be formed from the respective cardboard better than the other. Said criteria may for example define a trade-off between minimum stability needed for a box containing items of a certain weight and size, minimum weight of the box and minimum material used. Hardware, namely at least one microprocessor 35, may execute processor-executable instructions and data stored by one or more nontransitory processor-readable medium 36 (e.g., volatile memory for instance random access memory (RAM) or memory registers or caches; non-volatile memory for instance read only memory (ROM), EEPROM, Flash memory, magnetic disks, optical disks) communicatively coupled to the microprocessor 35 to control the apparatus. In some implementations, the microprocessor 35 may automatically select a single-faced cardboard for creating a certain piece of cardboard that meets said criteria best. As will become apparent from the following description, such microprocessor 35 may in certain embodiments even optionally select one or more additional layers used in creating the cardboard.

The at least one microprocessor 35 can obtain information on the arrangement to be shipped, the information relating to at least one of overall dimensions, weight, shape, shipping conditions, fragility, sensitivity to moisture, value, shipping destination, etc. This information may for example be obtained from an item property database or other data structure 36*a* and/or an order database stored by the one or more processor-readable medium 36. A packaging system employing the apparatus for creating cardboard may comprise hardware such as a scanner for obtaining dimensions of the items to be shipped together in a box, and/or a scale for weighing the item(s). The data thus obtained may then be processed by said at least one microprocessor 35 executing the processor-executable instructions to determine a box, which fulfils predefined criteria best, and to select the materials for creating cardboard for such box. The arrangement of items to be shipped could be scanned, and at least the dimension of this arrangement of items could be used for determining the appropriate packaging material and the blank size.

The piece of cardboard shown in FIG. 2A is made by attaching the closing layer 30 to the open side of the first single-faced cardboard, while the piece of cardboard shown in FIG. 2B is made by attaching the closing layer 30 to the open side of the second single-faced cardboard. FIG. 2C shows a piece of cardboard made of the closing layer 30, the first single-faced cardboard and the second single-faced cardboard.

While the apparatus shown in FIG. 1 comprises two separate attaching stations 32 and 34, and—if selected—the first single-faced cardboard and the second single-faced cardboard would in this embodiment be attached to each other prior to attaching the closing layer, as is apparent form the teachings herein the closing layer may be attached, e.g., to the first single-faced cardboard prior to attaching the second single-faced cardboard or any other layer, which will be described below. Furthermore, as apparent from the teachings here, instead of two (or more if more layers are to be attached) separate attaching stations, the cardboard can be formed in a single attaching station.

Depending on the needs of the user of such apparatus, further supply stations may be provided, for example one or more stations that respectively supply different types of closing layers so that the microprocessor cannot only select one or both of two different types of single-faced corrugated cardboard, but can also select a closing layer out of two or even more different types of closing layers. The closing layers may, for example, have different printings or markings on it, allowing the operator of a warehouse to offer personalized "drop shipment" for different customers, for which he would send out packages created on-site with the closing layer bearing, for example, the name or logo of the respective one of a number of different customers. Providing different closing layers 26 also allows adapting the properties of the cardboard to particular needs, for example to create boxes with water repellent properties and/or a special stability. Also, a supply station for providing further types of single-faced cardboard and/or for providing so-called special property layers may be provided, as will be explained below.

For attaching the single-faced cardboards, the closing layer, and any other layer that may be selected for creating a certain piece of cardboard, different methods can be used, and in particular the method used for, e.g., attaching the second single-faced cardboard to the first single-faced cardboard, may be another method than that used for attaching the closing layer. In the embodiment shown in FIG. 1, the attaching station 34 comprises a glue applying unit 37, in which glue is applied to the closing layer 30, and a pressing roller 38 for pressing the closing layer against the open side of the respective single-faced cardboard. Some of these methods of attaching are described in EP 3 050 809 A1, to whose disclosure it is referred herewith. As indicated by arrow 40, the resulting corrugated cardboard can then be fed into a machine for automatically forming packaging boxes from the cardboard.

Figure 3:
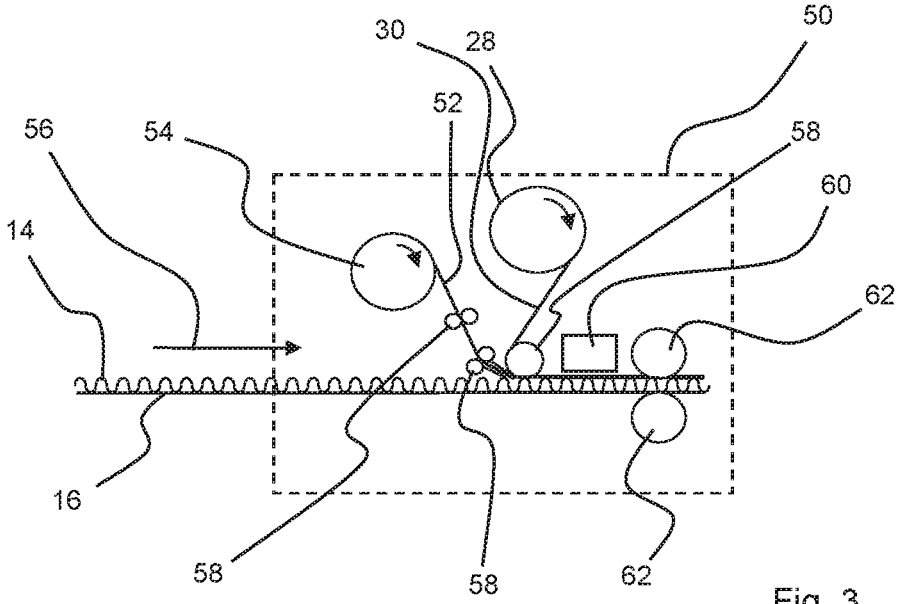
FIG. 3 is a schematic diagram of a specific attaching station.

FIG. 3 shows another embodiment of an attaching station 50 which attaches the closing layer 30 to single-faced cardboard. This attaching station 50 is adapted to attach, on-demand, at least one additional layer 52 supplied from a supply station 54 to either one or both of the closing layer 30 and the selected single-faced cardboard, which in the depicted case is the first single-layer cardboard comprising the corrugated layer 14 and the flat layer 16 and which is fed to the attaching station 50 as indicated by arrow 56. It should be understood that, as explained above in conjunction with FIGS. 1 and 2, either one or both of the single-faced corrugated cardboards could be supplied to the attaching station 50, and in certain cases even more than two supply stations to supply single-faced cardboards may be employed. The selection, which single-faced cardboard(s) are used for producing a specific piece of cardboard, can depend on different factors as will be explained below, and the selection can be made automatically by the hardware (e.g., microprocessor 35 executing the processor-executable instructions stored by the nontransitory processor-readable medium 36) controlling the apparatus, e.g. the at least one microprocessor described above.

Depending on the specific needs that usually occur at the system to automatically form packaging boxes, at which the apparatus to create cardboard is used, the at least one additional layer 52 may for example be a shock protection layer, a water protection layer, or a reinforcing layer, in particular a web of strong fibers, which could also add tamper-proof features to a box formed of the respective cardboard created. As such layers add special properties to the cardboard, they are herein referred to as special property layers. Depending on the specific needs of a certain box, more than one additional layer may be supplied and put on top of each other or may even be applied to different regions of the cardboard, such that different areas of a box finally folded from such cardboard have different properties.

In this embodiment, the additional layer 52 and the closing layer 30 are fed towards the single-faced corrugated cardboard through a number of guiding rollers 58, some of which may be driven and of which, for the sake of clarity, only some have been provided with reference numbers. In the illustrated arrangement, the additional layer 52 will be sandwiched between the single-faced corrugated cardboard and the closing layer. However, as would be apparent from the teachings herein, the arrangement may alternatively place the closing layer sandwiched between the additional layer and the single-faced corrugated cardboard or such that the single-faced corrugated cardboard is sandwiched between the additional layer and the closing layer. In such case, the arrangement may place the additional layer on the outside or on the inside of a box folded from the cardboard thus produced. For example, if the special property added to the cardboard by the additional layer is water repellency, the user may want to have such layer on the outside of the box. If the special property added to the cardboard by the additional layer is tear strength, the user may want to have such layer between the single-faced-corrugated cardboard and the closing layer. If the special property added to the cardboard by the additional layer is shock protection, the user may want to have such layer on the inside of the box.

Of course, more than one special property layer may be used for one specific box. Additionally, an information carrier such as an RFID tag may be attached to the selected single-faced cardboard or a layer being attached thereto, in particular in such way that the information carrier is sandwiched and hence protected. Such information carrier facilitates providing certain information, such as destination, sender of a parcel, packing date, postage paid etc. about a parcel that been created by using the respective cardboard. If, for example, RFID-tags are used, the information may be read automatically and contactlessly, such that additional stickers or stamps are not necessary.

In the embodiment shown in FIG. 3, the single-faced corrugated cardboard, the additional layer 52 and the closing layer 30 pass an activation unit 60 that activates an adhesive layer provided on one or more of the single-faced corrugated cardboard, the additional layer 52 and the closing layer 30. The adhesive layer may for example be hot melting glue, in case of which the activation unit 60 will accordingly include structure (e.g., heating coil, hot air jet) to heat the adhesive layer. The single-faced corrugated cardboard, the additional layer 52 and the closing layer 30 than pass a pair of pressing rollers 62, where they are securely fixed to each other. As one will appreciate from the teachings herein, instead of just one additional layer, two or more additional layers may be attached in a likewise manner. As one will appreciate from the teachings herein, instead of activating the adhesive layer after the different layers have been brought into contact with each other, such activation may be done prior to bringing the layers into contact with each other.

Figure 4:
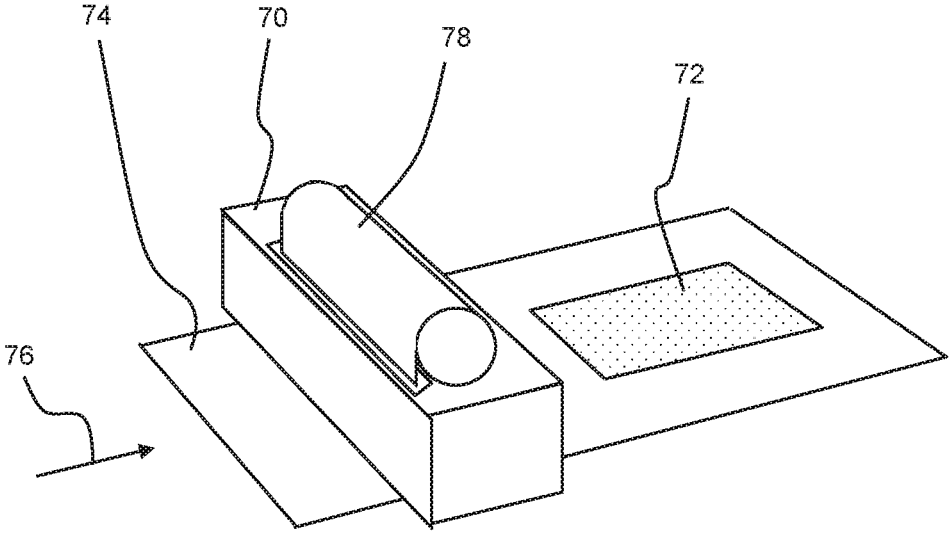
FIG. 4 is a schematic diagram of parts of another specific attaching station.

FIG. 4 shows an attaching station 70 adapted to attach on-demand an additional layer 72 to a material 74 fed to the attaching station 70 as indicated by arrow 76. The material 74 can be either one of the closing layer and the selected single-faced cardboard, and the attaching process can be done prior to or after attaching the closing layer to the selected single-faced cardboard. The additional layer 72 is supplied from a supply station 78 and can, depending on the specific needs that usually occur at the system for automatically forming packaging boxes, at which the apparatus that creates the cardboard is used, be in particular single-faced cardboard, a shock protection layer, a water protection layer, or a reinforcing layer.

A particularity of the attaching station 70 is that it is adapted to attach the additional layer 72 to a part of the material 74, i.e. the selected single-faced cardboard or the closing layer. This allows optimizing the created cardboard under specific aspects, i.e. reinforcing only those parts of the cardboard that upon shipment of a box folded therefrom will need to be particularly strong. As described above in conjunction with FIG. 3, in certain cases it may be advantageous to provide more than one additional layer and to attach such layers on-demand to certain areas of the material 74. As also described above, the expert can advantageously choose amongst different methods for attaching the layer(s) to the material 74.

Generally, to attach the closing layer to a selected single-faced cardboard, to attach a single-faced cardboard to another single-faced cardboard and to attach additional layers, one or more gluing units may be provided to apply glue to one or both of the materials that are to be attached to each other. Also, some of the materials, like in particular the closing layer and/or the open sides of the single-faced cardboards, may carry an adhesive substance (e.g., adhesive) that has been applied to the respective material prior to supplying them to the site for creating the cardboard. The adhesive substance can be of many different types, so one can choose the appropriate adhesive substance for the respective needs of the customer, depending in particular on the material used for creating the cardboard, the required stability etc.

In one particular embodiment, both materials to be attached to each other are provided with adhesive substances, which, when brought into contact with each other, show adhesive properties. In such case, the respective materials can easily be wound up for storing and transporting on respective rolls without needing cover sheets for covering the adhesive substances in order to prevent that a material sticks together on the roll. Such substances may form a kind of two-component adhesive (e.g., two part epoxy).

In another embodiment, the adhesive substance is provided on the corrugated layer of the single-faced cardboards and is of the so-called self-adhesive type used for example for self-adhesive stickers. It is sufficient to provide the adhesive substance only on the areas of the crests of the corrugated layer, as only these areas will come into contact with another layer like the closing layer or any other layer to be attached to the corrugated side. In order to facilitate that the single-faced cardboard can be coiled up on roll while preventing that upon coiling-up the side of the corrugated layer provided with the adhesive substance sticks to the respective flat layer, a protective layer covering the adhesive substance may be provided on the corrugated layer. Such protective layer may have a first side that does not adhere to said adhesive substance and a second side that adheres to the adhesive substance, so that the protective layer can even be first used for covering the adhesive substance on the corrugated layer, then be removed and turned and re-used as closing layer.

For certain applications, it may be advantageous to use a type of adhesive substance provided on the corrugated layer and/or the layer(s) to be attached to it that has to be activated, in particular by heat, light, a liquid (e.g. water), pressure or the like, to show adhesive properties. Accordingly, an activation unit like the one shown in FIG. 3 may comprise a radiant element to generate heat, a light source to emit light, a press or roller to generate pressure or force, and/or a sprayer to spray said liquid.

Figure 5:
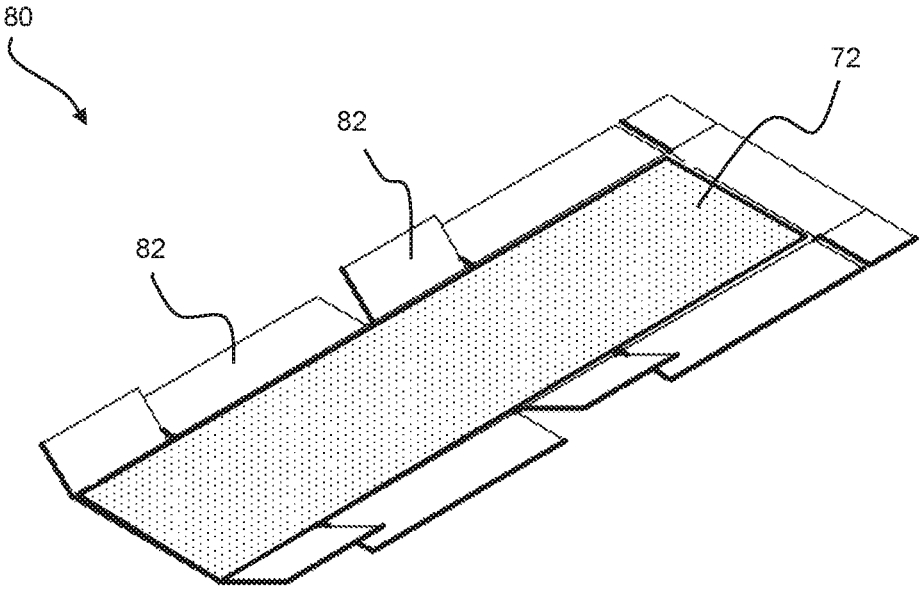
FIG. 5 is an isometric view that shows a blank created from cardboard formed with an apparatus according to FIG. 4.

FIG. 5 shows a blank 80 for folding a box, the blank being formed from a piece of cardboard created using the attaching station 70 shown in FIG. 4.

The blank has the additional layer 72 and a number of so-called side panels 82, of which only some are provided with reference numbers and which are formed through a number of cutting and creasing acts performed on the piece of cardboard. These acts as well as the shape of the blank 80 will be apparent to the skilled reader. As shown in FIG. 5, the additional layer 72 in this example is not present in the parts of the blank that form the side panels 82.

Various embodiments described herein advantageously allows creating a variety of cardboards adapted to the needs of a specific box to be formed, while keeping the number of different materials to be kept ready for creating the cardboard at a minimum.

Various embodiments described herein advantageously provides a huge variety of ways to optimize the packaging process not only in terms of minimizing the amount of material necessary for creating the package, but also to obtain the protection required for the specific item(s). For example, an operator of the system can predetermine that for certain goods always a shock absorbing layer (e.g. protective bubble foil) or a water repellent layer (e.g. foil) or the like is applied. This may also be done dependent on the shipment address, since this address may be linked to certain transportation conditions, due to which it might be likely that the package will be subjected to e.g. humidity.

The invention claimed is:

1. A method of creating corrugated cardboard on the site of a system for automatically forming packaging boxes for packaging an arrangement of one or more item(s) to be shipped, said corrugated cardboard having at least one corrugated layer between two flat layers, the method comprising:

providing at least three different types of packaging material, namely a first single-faced corrugated cardboard, a closing layer and at least one second single-faced corrugated cardboard, wherein each single-faced corrugated cardboard comprises a corrugated layer having a closed side with an attached flat layer and an open side opposite to said closed side, obtaining information on the arrangement to be shipped, the information relating to at least one of overall dimensions, weight, shape, shipping conditions, fragility, sensitivity to moisture, value, or shipping destination, based on the obtained information, selecting by a microprocessor amongst the provided packaging material at least one single-faced corrugated cardboard, feeding an amount of said selected single-faced cardboard to an attaching station, attaching at the attaching station the closing layer to the selected single-faced cardboard to sandwich the corrugated layer between the flat layer and the closing layer.

2. The method according to claim 1, further comprising: attaching to the selected single-faced cardboard and/or to the closing layer at least one additional layer.

3. The method according to claim 2, wherein said at least one additional layer is attached only to a part of said selected single-faced cardboard and/or of said closing layer.

4. The method according to claim 1, wherein at least two different single-faced corrugated cardboards are provided that differ in at least one of tear strength, stiffness, thickness, grammage and water repellency.

5. The method according to claim 1, wherein at least one of said layers and/or said single-faced corrugated cardboards to be attached to each other carries an adhesive substance.

6. The method according to claim 5, wherein said adhesive substance is a substance that has to be activated by heat, light, a liquid or pressure to show adhesive properties.

7. The method according to claim 1, wherein the information on the arrangement to be shipped is obtained from at least one of an order database, an item database, user input, scanning the item(s) and/or weighing said item(s).

8. The method according to claim 1, further comprising: attaching an RFID tag to one of the selected single-faced cardboard(s) or the layer(s) being attached thereto.

9. The method according to claim 1, further comprising: automatically forming packaging boxes from the cardboard.

10. Apparatus to create corrugated cardboard on a site of a system for automatically forming packaging boxes for packaging an arrangement of one or more item(s) to be shipped, said corrugated cardboard having at least one corrugated layer between two flat layers, the apparatus comprising at least three supply stations to respectively supply at least three different types of packaging material, namely a first single-faced corrugated cardboard, a closing layer and at least one second single-faced corrugated cardboard, wherein each single-faced corrugated cardboard comprises a corrugated layer having a closed side with an attached flat layer and an open side opposite to said closed side, a microprocessor communicatively coupled to receive information on the arrangement to be shipped, the information relating to at least one of overall dimensions, weight, shape, shipping conditions, fragility, sensitivity to moisture, value, shipping destination, and the information to select amongst the provided packaging material at least one single-faced corrugated cardboard, an attaching station to attach the closing layer to the selected single-faced cardboard to sandwich the corrugated layer between the flat layer and the closing layer.

11. The apparatus according to claim 10, wherein said attaching station or a separate attaching station attaches at least one additional layer to said selected single-faced cardboard and/or to said closing layer.

12. The apparatus according to claim 11, wherein said attaching station or said separate attaching station attaches at least one additional layer only to a part of said selected single-faced cardboard and/or of said closing layer.

13. The apparatus according to claim 10, further comprising a removal unit that removes a protective layer from the closing layer and/or the open side of said selected single-faced cardboard, said protective layer protecting an adhesive substance provided on the open side of the single-faced cardboard or on the closing layer.

14. The apparatus according to claim 10, further comprising an activation device that selectively activates an adhesive substance provided on the open side of the selected single-faced cardboard or on the closing layer.

15. The apparatus according to claim 10, further comprising the system for automatically forming packaging boxes from the cardboard.

* * * * *